US005988218A

United States Patent [19]

Hecking

[11] Patent Number: 5,988,218

[45] Date of Patent: Nov. 23, 1999

[54] CONNECTION FITTING FOR CONNECTING A PRESSURE EXPANSION VESSEL FOR HEATED DRINKING WATER

[75] Inventor: Willi Hecking, Mönchengladbach, Germany

[73] Assignee: Hans Sasserath & Co. KG, Germany

[21] Appl. No.: 09/095,480

[22] Filed: Jun. 10, 1998

[30] Foreign Application Priority Data

Jun. 10, 1997 [EP] European Pat. Off. ..... 97250179

[51] Int. Cl.[6] ..... F16K 11/087

[52] U.S. Cl. ..... 137/625.29; 138/30

[58] Field of Search ..... 137/625.29, 599, 137/501 A; 138/30; 122/35; 126/362, 380

[56] References Cited

U.S. PATENT DOCUMENTS 5,052,657 10/1991 Winship ..... 251/160
5,622,207 4/1997 Frank ..... 137/561 A

FOREIGN PATENT DOCUMENTS

0602430 B1 11/1993 European Pat. Off. .
19529959 A1 2/1997 Germany .
29621353 U1 3/1997 Germany .

*Primary Examiner*—John Fox
*Attorney, Agent, or Firm*—Mallinckrodt & Mallinckrodt

[57] ABSTRACT

The invention relates to a connection fitting for connecting a pressure expansion vessel to a conduit system, in which a water flow flows, a diaphragm dividing said vessel into a cavity filled with water and a pressurized gas chamber filled with pressurized gas. The fitting comprises a suction device, in which a suction is generated by the water flow and a water exchange flow is generated by means of this suction along a flow path extending parallel to the water flow and through the cavity. A plug valve is arranged to shut off the parallel flow path. The valve plug is directly arranged between a first formed body forming the suction device and located adjacent to the water flow and a second formed body likewise located in the connecting socket on the side of the pressure expansion vessel. The formed bodies and the valve plug have coaxial passages, which are aligned with each other and form forward-flow path and return-flow path of a flow path parallel to the water flow. The suction device is formed by a bent-off end of the return-flow path extending into the water flow.

22 Claims, 5 Drawing Sheets

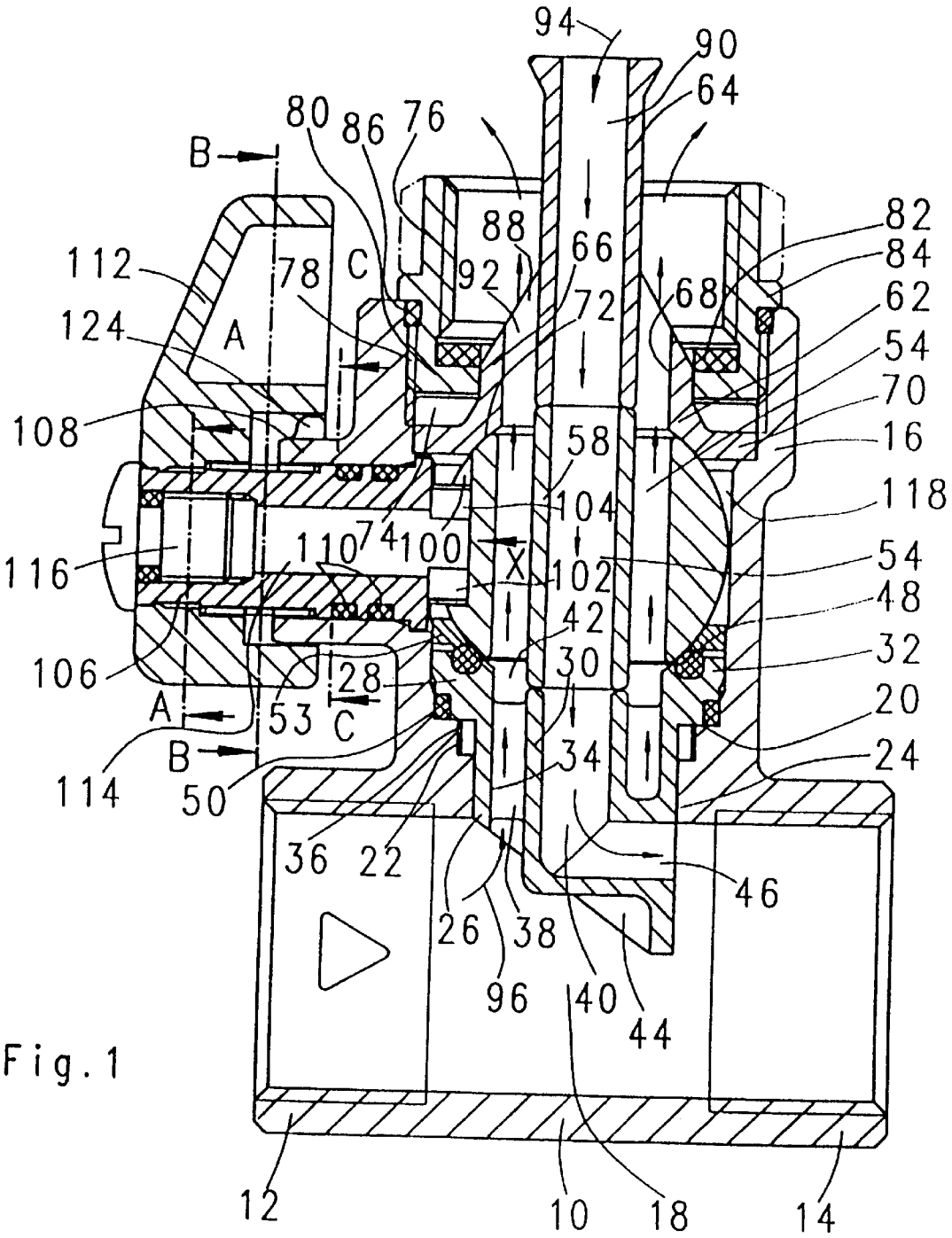
Fig. 1
A-A
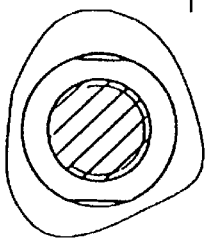
Fig. 3
Fig. 6
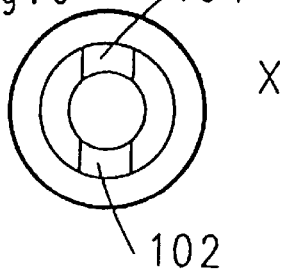

Fig.2
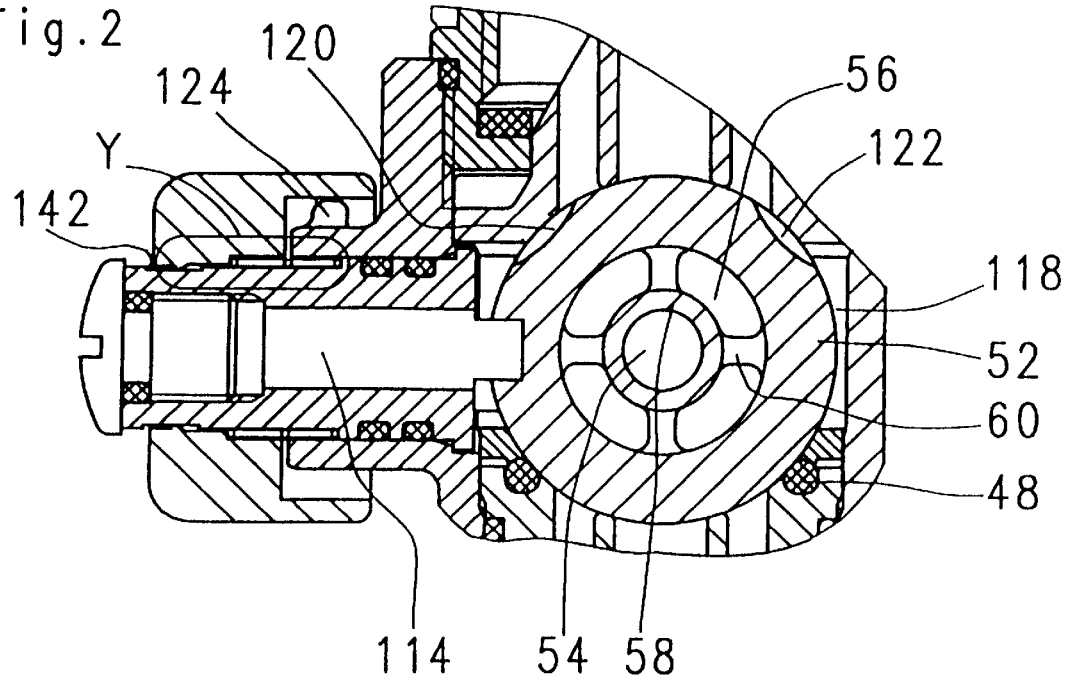
Fig.7
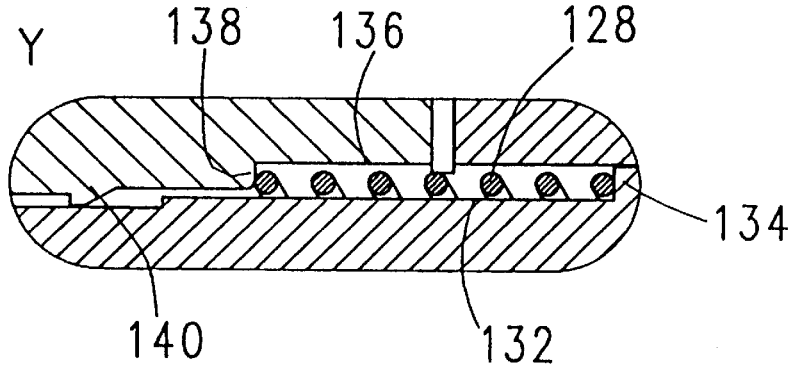
C-C
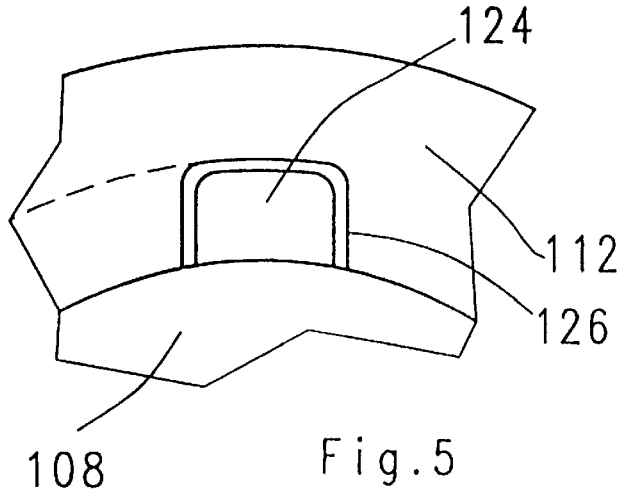
Fig.5

CONNECTION FITTING FOR CONNECTING A PRESSURE EXPANSION VESSEL FOR HEATED DRINKING WATER

BACKGROUND OF THE INVENTION

This invention relates to a connection fitting for connecting a pressure expansion vessel to a conduit system, in which a water flow flows, a diaphragm dividing said vessel into a cavity filled with water and a pressurized gas chamber filled with pressurized gas, wherein said connection fitting comprises a suction device, in which a suction is generated by said water flow, and a water exchange flow is generated by means of said suction along a flow path extending parallel to said water flow and through said cavity.

This invention particularly relates to a connection fitting of this type, wherein a plug valve having a valve plug is arranged to shut off said parallel flow path, said connection fitting comprises a fitting basic body having a connecting socket for said pressure expansion vessel, said valve plug of said plug valve is arranged in said connecting socket for said pressure expansion vessel between a first formed body forming said suction device and located adjacent to said water flow and a second formed body likewise located in said connecting socket on the side of said pressure expansion vessel, and said second formed body has a tubular central portion and an annular portion surrounding said tubular central portion and connected to said tubular central portion by webs.

DESCRIPTION OF THE PRIOR ART

There are drinking water heaters, where the water to be heated is heated in a closed container, for example by heat exchange with heating water. During the heating the drinking water expands. This expansion has to be taken into account. For this purpose usually water is let off through a diaphragm actuated safety valve. This requires an outlet port for the expansion water to be let off. The volume of the expansion water lost thereby can amount to up to ten liters per day for a four-persons household depending on the installation and the size of the drinking water heater. This adds up to considerable losses of water and energy.

Therefore it is known to connect expansion vessels, which accommodates the expansion water, with the system of the drinking water heater. Known instruments of this kind comprise a bladder diaphragm, which is arranged in a housing filled with pressurized gas. The rim of an inlet port of the bladder diaphragm is connected with the rim of the inlet port of the housing. The inlet ports are connected with the system of the drinking water heater. Pressurized gas is filled into the volume between the bladder diaphragm and the housing through a filling valve.

These expansion vessels are problematic for drinking water heaters for hygenic reasons. They contain stagnating and non-exchanged water volumes.

A further problem with such expansion vessels is that the maintenance and testing of such vessels is difficult. During operation the bladder diaphragm is exposed, from the inside, to the drinking water, which is pressurized with operating pressure. On the outside the pressure of the pressurized gas prevails. The pressure of the pressurized gas in the housing should be checked through the filling valve. A pure pressure test by measuring the pressure at the filling valve in the operation mode does not allow the conclusion whether the expansion vessel is working or not, i.e. whether the housing contains enough pressurized gas. A gas pressure corresponding to the operation pressure of the water is maintained by the diaphragm. For the test the expansion vessel has to be separated from the drinking water system. The diaphragm has to be relieved from the water pressure. Only then a useful measurement of the pressure at the filling valve can be carried out to check the gas cushion of the pressurized gas.

EP-A-0 602 430 describes a connection vessel for heated drinking water having a cavity closed by a bladder diaphragm and communicating with a drinking water heater. A pressurized gas chamber limited by a housing is located adjacent to the cavity. For connecting the cavity with an inlet and for directly connecting the inlet with an outlet, the connection fitting is designed in such a manner, that a water exchange flow through the cavity is generated when hot drinking water is drawn. For this purpose the connection fitting has a direct flow passage between inlet and outlet by-passing the cavity. Furthermore, this flow passage is a flow path extending parallel to the direct flow passage and through the cavity. A suction device is provided in this parallel flow path. The suction device generates a suction by means of the flow of water flowing in the direct flow path. When drinking water is drawn the water exchange flow is generated by this suction through the parallel flow path through the cavity into the downstream part of the direct flow path.

In one embodiment of the EP-A-0 602 430 the inlet and the outlet of the connection fitting are arranged adjacent to each other. The direct flow passage is an aperture in a partition separating the inlet from the outlet. The connection fitting comprises a forwardflow path and a return-flow path of the parallel flow path. The return-flow path ends in a tube projection of a first formed body comprising a passage section of the return-flow path. The formed body in inserted into a connecting socket of a basic body. The tube projection extends coaxially with the outlet and into the outlet. When drinking water is drawn, a suction is generated in the tube projection by injector effect.

A ball valve is arranged to simultaneously close the forward-flow path and the return-flow path. The valve ball of the ball valve has a straight diametrical passage in the return-flow path. Slots are formed in the ball valve on both sides of the passage, an annular space being formed between the ball valve and the inner wall of the connecting socket. A passage communicating with the inlet and forming a section of the forward-flow passage of the parallel flow path ends in this annular space. A second formed body is located in the connecting socket on the side of the valve ball remote from the pressure expansion vessel. The second formed body has two coaxial passages. The inner one of these two passages is aligned with the diametrical passage of the valve ball. The outer one of these passages communicates at one end with the slots of the valve ball and, thus, with the annular space and at the other end with an inlet of the cavity. The inner one of the passages communicates with an outlet tube extending into the cavity and provided with outlet openings.

In the known embodiment the valve ball is held between particular bearing rings having concavo-spherical bearing surfaces. The bearing rings are located between the formed bodies and the valve ball.

An actuating spindle is arranged to rotate the valve ball by 90° from an operating position, in which the forward-flow path and the return-flow path are open, into a locking position. The actuating spindle has a longitudinal passage, which communicates with an outlet through a valve. The longitudinal passage communicates with the cavity. The cavity can be drained in the locking position in order to control the pressure in the chamber filled with pressurized gas.

In another embodiment of the EP-A-0 602 430 the inlet and the outlet are arranged coaxially. The suction device is a venturi tube.

DE-A-195 29 959 describes a connection fitting for connecting a pressure expansion vessel to a conduit system. The connection fitting comprises a main flow passage forming part of the conduit system and a flow path parallel with the main flow passage and extending through the cavity of the pressure expansion vessel. As in EP-A-0 602 430 the parallel flow path is provided with a suction device in the main flow path in the opening area of the return-flow path. The suction device generates a water exchange flow through the parallel flow path.

In the arrangement of the DE-A-195 29 959 the fitting basic body is T-shaped. The main flow passage forms the through-T-web. The parallel flow passage is integrated in the T-leg. The parallel flow path is divided by a patition thereby forming the forward-flow path and the return-flow path. The partition extends into the area of the T-web. An opening is provided in the partition there. A tube body forming part of the suction device is located in the opening.

A ball valve is located in the T-leg of the fitting basic body. This ball valve is arranged to simultaneously close the forward-flow passage and the the return-flow passage of the parallel flow path extending side-by-side on both sides of the partition.

SUMMARY OF THE INVENTION

The object of the present invention is to simplify the design of a connection fitting of the type mentioned above.

According to the invention this object is achieved in that the second formed body has a bearing surface for the valve plug, said valve plug is held between the first formed body and the second formed body, the two formed bodies have aligned coaxial passages, said valve plug has coaxial passages, and said coaxial passages of said formed bodies are aligned with said coaxial passages of said valve plug in an operating position, a first set of said aligned coaxial passages forming a forward-flow path of said parallel flow path and a second set of aligned coaxial passages forming a return-flow path of said parallel flow path.

In this connection fitting the forward-flow path and the return-flow path extend coaxially in both formed bodies. The valve ball likewise has coaxial through-passages. The valve ball is not held in particular bearing rings but held directly between the formed bodies. Thus, the design is considerably simplified.

According to another aspect of the invention, in a connection fitting for connecting a pressure expansion vessel for heated drinking water, the suction device is designed in such a manner, that the forward-flow path and the return-flow path are formed by coaxial passages including an inner passage and an outer passage, said forward-flow path being formed by said outer coaxial passage and said return-flow path being formed by said inner coaxial passage, a formed body has a central portion comprising an inner passage forming part of said return-flow path, said central portion extending into said water flow, said inner passage of said formed body having an end located on the outlet side, said end forming an angle and having a part extending in the direction of the water flow, and an outer passage of said formed body being part of said forward-flow path communicates with said water flow through an inlet opening extending in an arc around said central portion.

Thus, the suction device and the passage guiding is very simple. It has been shown, that a suction device constructed in this manner generates a suction, which is sufficient to provide the required water exchange flow through the parallel flow path and the cavity of the pressure expansion vessel.

Further objects and features of the invention will be apparent to a person skilled in the art from the following specification of a preferred embodiment when read in conjunction with the appended claims.

BRIEF DESCRIPTION OF THE DRAWING

An embodiment of the invention and a number of modifications will now be described in greater detail with reference to the accompanying drawings.

FIG. 1 shows a longitudinal section of a connection fitting for connecting a pressure expansion vessel;

FIG. 2 shows a part of a longitudinal section similar to FIG. 1, the ball valve being in its closed position;

FIG. 3 shows a section taken along line A—A in FIG. 1;

FIG. 5 shows a section taken along line C—C in FIG. 1 at enlarged scale with portions broken away;

FIG. 6 shows a view in the direction "X" in FIG. 1;

FIG. 7 shows a detail "Y" of FIG. 2 at enlarged scale;

DESCRIPTION OF THE PREFERRED EMBODIMENTS

Figure 4:
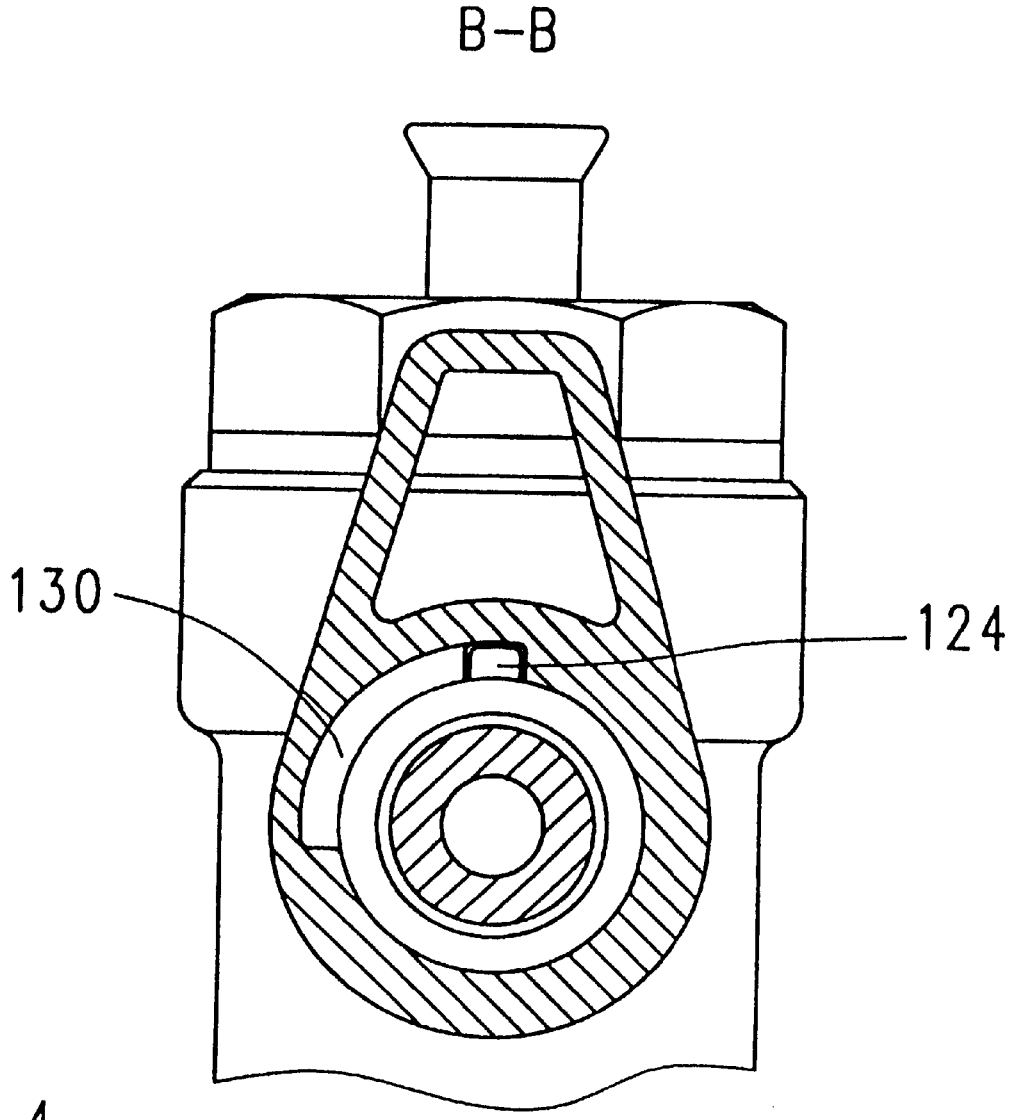
FIG. 4 shows a section taken along line B—B in FIG. 1.

Referring now to FIG. 1, there is shown a fitting basic body 10. The fitting basic body 10 has an inlet 12 in the form of an inlet socket and an outlet 14 in the form of an outlet socket. The inlet 12 and the outlet 14 are arranged coaxially on opposite sides of the fitting basic body 10. Furthermore, the fitting basic body 10 has a connecting socket 16. The axis of the connecting socket 16 extends perpendicular to the common axis of the inlet 12 and the outlet 16 approximately in the middle therebetween. The inlet 12 and the outlet 14 communicate with each other through a direct flow passage 18. In the embodiment of FIG. 1 the inlet 12, the flow passage 18 and the outlet 18 practically form a through-tube piece of substantially constant cross-section.

The connecting socket 16 departs from the flow passage 18. The inner wall of the connecting socket 16 forms a step or annular shoulder 20. A radial recess 22 open toward the annular shoulder 20 is adjacent to the annular shoulder 20. Adjacent to the recess 22 there is an aperture 24, through which the connecting socket 16 communicates with the flow passage 18.

A first formed body 26 is inserted into the connecting socket 16. The first formed body 26 has an outer portion 28 and a central portion 30 coaxial thereto. The outer portion 28 has a larger-thickness annular section 32 and a tubular section 34. The section 32 is located on the annular shoulder 20. The tubular section 34 is inserted in the aperture 24. Radial tappets 36 are integral with the tubular section 34. The tappets 36 are accommodated in the radial recesses 22. The recesses 22 and the tappets 36 ensure, that the first formed body only can be inserted into the connecting socket 16 in a well-defined position. The outer portion 28 and the central portion 30 are interconnected by radial webs 38. The tubular central portion 30 forms a central passage 40, which is coaxial to an annular passage 42 interrupted by the webs 38 and formed between the outer portion 28 and the central portion 30.

The formed body 26 extends into the flow passage 18. The section of the outer portion 28 extending into flow passage 18 is cut off inclinedly along a surface 44. On the inlet side this section extends approximately to the inner wall of the flow passage 18, whereas, on the outlet side, the section extends approximately to the axis of the outlet. In the area of the flow passage 18 the passage 40 of the central portion 30 is bent off by 90° in direction of the outlet, such that an end portion 46 of the passage extends in the flow direction of the flow flowing from the inlet to the outlet. The passage extends through the wall of the outer portion and ends on the outlet side in the flow passage 18 or the outlet 14.

The annular larger-thickness section 32 of the outer portion 28 carries an O-ring 48. Furthermore, the outlet portion 28 is sealed against the connecting socket 16 by an O-ring 50.

A valve plug formed as valve ball 52 engages the O-ring 48 of the outer portion 28. The O-ring 48 is held by a supporting disc 53. The supporting disc 53 engages the O-ring 48 outside the engagement surface, with which the O-ring 48 engages the valve ball. The valve ball 52 is located in the connecting socket 16.

The valve ball 52 has a diametrical passage 54, which, in the illustrated operation position, is aligned with the passage 40 of the central portion 30 of the first formed body 26. Furthermore, the valve ball 52 has an annular passage 56. The annular passage 56 is coaxial with the diametrical passage 54. A tube section 58 is formed between the diametrical passage 54 and the annular passage 56. The tube section 58 is connected to the the rest of the valve ball 52 through radial webs 60. This can best be seen in FIG. 2.

Furthermore, a second formed body is inserted in the connecting socket 16 on the outer side of the valve ball 52. The second formed body 62 has a tubular central portion 64 and an outer portion 66 surrounding the central portion 64. The outer portion 66 surrounds the central portion 64 coaxially. The outer portion 66 has a cylindrical section 68 and a flange 70 on the side of the ball. A concavo-spherical annular bearing surface 72 is formed at the inner edge of the flange 70. The bearing surface 72 directly engages the valve ball 52. On its side remote from the valve ball 52 the flange 70 has webs 74 projecting perpendicularly to the surface of the flange 70.

A sleeve-shaped screw-in element 76 is screwed into an internal thread 78 of the connecting socket 16. The screw-in element 76 is located with an edge 80 projecting inwards on the webs 74 of the flange 70. A sealing washer 82 is located on the edge 80. The screw-in element 76 has a collar 84. A sealing ring 86 is inserted between the screwin element 76, the collar 84 and the connecting socket 16.

The tubular central portion 66 of the second formed body 62 is connected to the outer portion 66 through radial webs 88. The central portion 64 extends out of the outer portion 66 and the connecting socket 16. The tubular central portion 64 forms an inner passage 90. An annular passage 92 interrupted by the webs 88 is formed between the central portion 64 and the outer portion 66.

The inner passages 90, 54 and 40, 46 are aligned with each other and form together a return-flow path 94 for a water exchange flow through a water-filled cavity of the pressure expansion vessel. A forward-flow path 96 is formed by the aligned outer or annular passages 42, 56 and 92. An outlet tube is located on the central portion 64. The outlet tube extends into the cavity of the pressure expansion vessel, as illustrated in EP-A-0 602 430.

The valve ball 52 has a slot 100, the central plane of which extends through the axis of the passages 54 and 56. Projections 102, 104 of an actuating spindle 106 extend into the slots 100. The actuating spindle 106 extends perpendicularly to the axis of the connecting socket 16. The actuating spindle 106 is mounted in a lateral bearing projection 108 of the connecting socket 16. The actuating spindle 106 is sealed against the bearing projection 108 by two seal rings 110. The projections 102, 104 are flat projection, which extend from the front surface of the actuating spindle 106 axially with respect to the axis of the actuating spindle 106 into the slot 100. The actuating spindle 106 is rotatable by 90° by means of an actuating handle 112 in a way still to be described. This rotates the valve ball 52 out of its operative position illustrated in FIG. 1 into the closed position illustrated in FIG. 2.

The actuating spindle 106 has a longitudinal passage 114. The longitudinal passage 114 is closed at its outer end by a detachable plug 116. The longitudinal passage ends at the inner front surface of the actuating spindle 106 between the projections 102 and 104 in an annular space 118, which is formed between the valve ball 52 and the inner wall of the connecting socket 16. As can be seen in FIG. 2, the valve ball 52 has recesses 120 and 122. In the closed position illustrated in FIG. 2 these recesses establish communication between the section of the forward-flow path 96 located on the side of the vessel and the annular space 118 and, thus, between the cavity of the pressure expansion vessel and the longitudinal passage 114. In the closed position of FIG. 2 the forward-flow path 96 and the return-flow path 94 are closed by the valve ball 52 and the O-ring 48 on the side of the fitting with respect to the annular space 118. If the detachable plug 116 is removed in this position, the water-filled cavity of the pressure expansion vessel can be drained. Then, for example, it is possible to measure the gas pressure in the pressure expansion vessel independently of the water pressure.

The actuating handle 112 is normally locked. For this purpose a tappet 124 is attached to the bearing projection 108 of the fitting basic body 10. The tappet 124 extends into a complementary recess 126 (FIG. 5) of the actuating handle 112. Thus, the actuating handle 112 is held in the position illustrated in FIG. 1. For actuating the actuating handle 112 the actuating handle 112 is pressed down to the right in FIG. 1 against the action of a spring 128. Then an arc-shaped undercut 130 (FIG. 4) of the actuating handle 112 extending over 90° is moved into the area of the tappet 124. With this undercut 130 the actuating handle 112 is rotatable clockwise by 90° in FIG. 4 towards the fitting basic body 10 into the closed position illustrated in FIG. 2.

The spring 128 is a helical spring. The spring 128 is located in a circumferential recess 132 of the actuating spindle 106 and engages with one end an annular shoulder 134 of the actuating spindle 106. The actuating handle 112 extends with a circumferential recess 136 over the spring 128. With its other end the spring 128 engages an annular shoulder 138 of the actuating handle 112. The spring 128 tends to push the actuating handle 112 to the left in FIG. 1 and, thereby, holds the tappet 124 in the recess 126. In order to prevent the spring 128 from pushing the actuating handle away from the actuating spindle, a collar 140 is attached to the actuating handle, in the path of which a stop 142 of the actuating spindle 106 is arranged.

Figure 8:
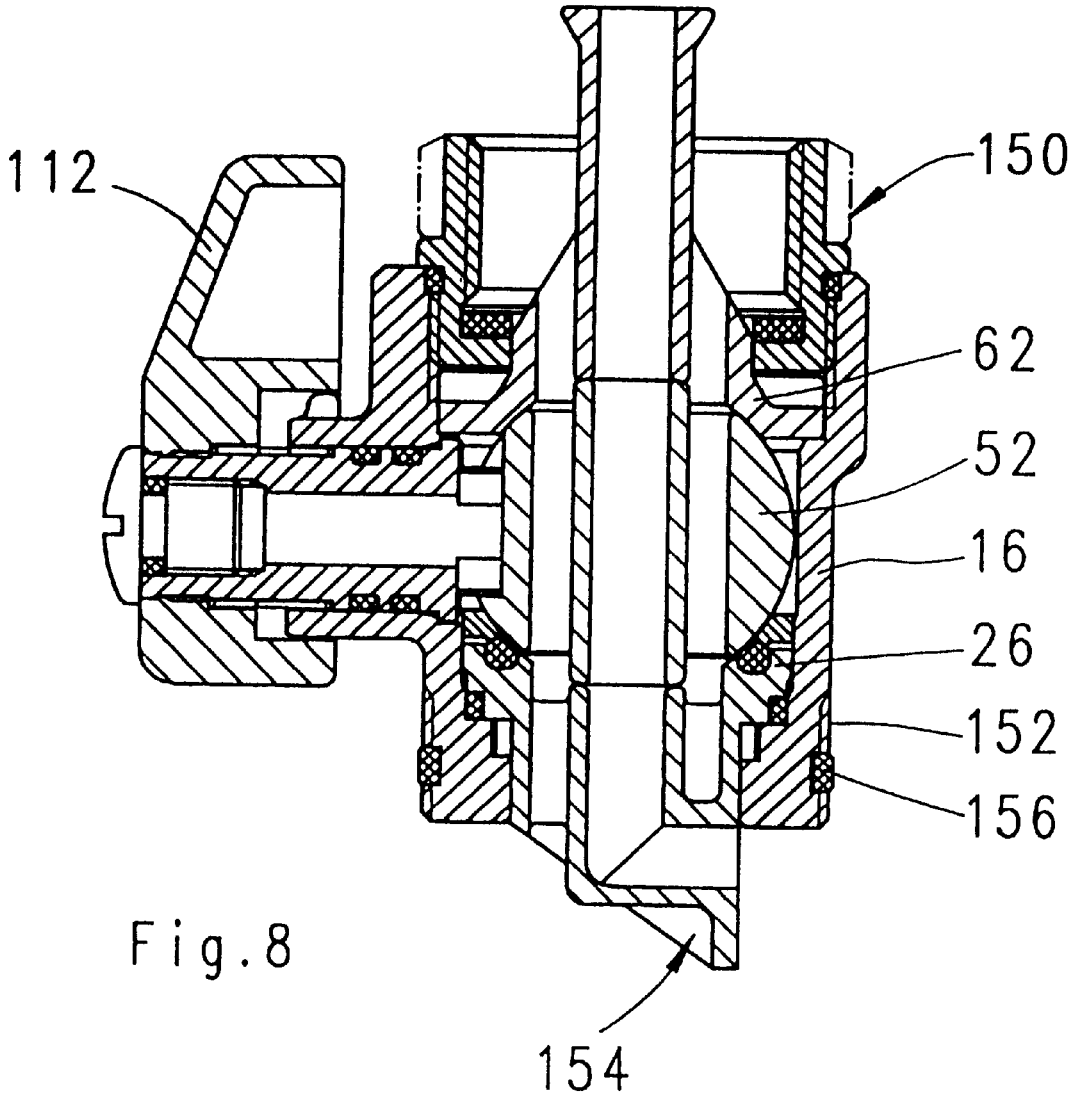
FIG. 8 is a section similar to FIG. 1 and shows a modification of the connection fitting.

The arrangement of FIG. 8 is similar to the arrangement of FIG. 1. Corresponding elements are designated by the same reference numerals in both figures.

In the arrangement of FIG. 8 the connecting socket 16 is a separate component, which forms an insert together with the first and the second formed body 26 and 62 and the valve ball 52 as well as with the actuating spindle 106 and the actuating handle 112. This insert 150 can be screwed by means of a thread 152 into a conventional installation having a T-piece. The positioning of the suction device 154 in the correct position is ensured by a teflon ring (asag ring) 156.

Figures 9, 10:
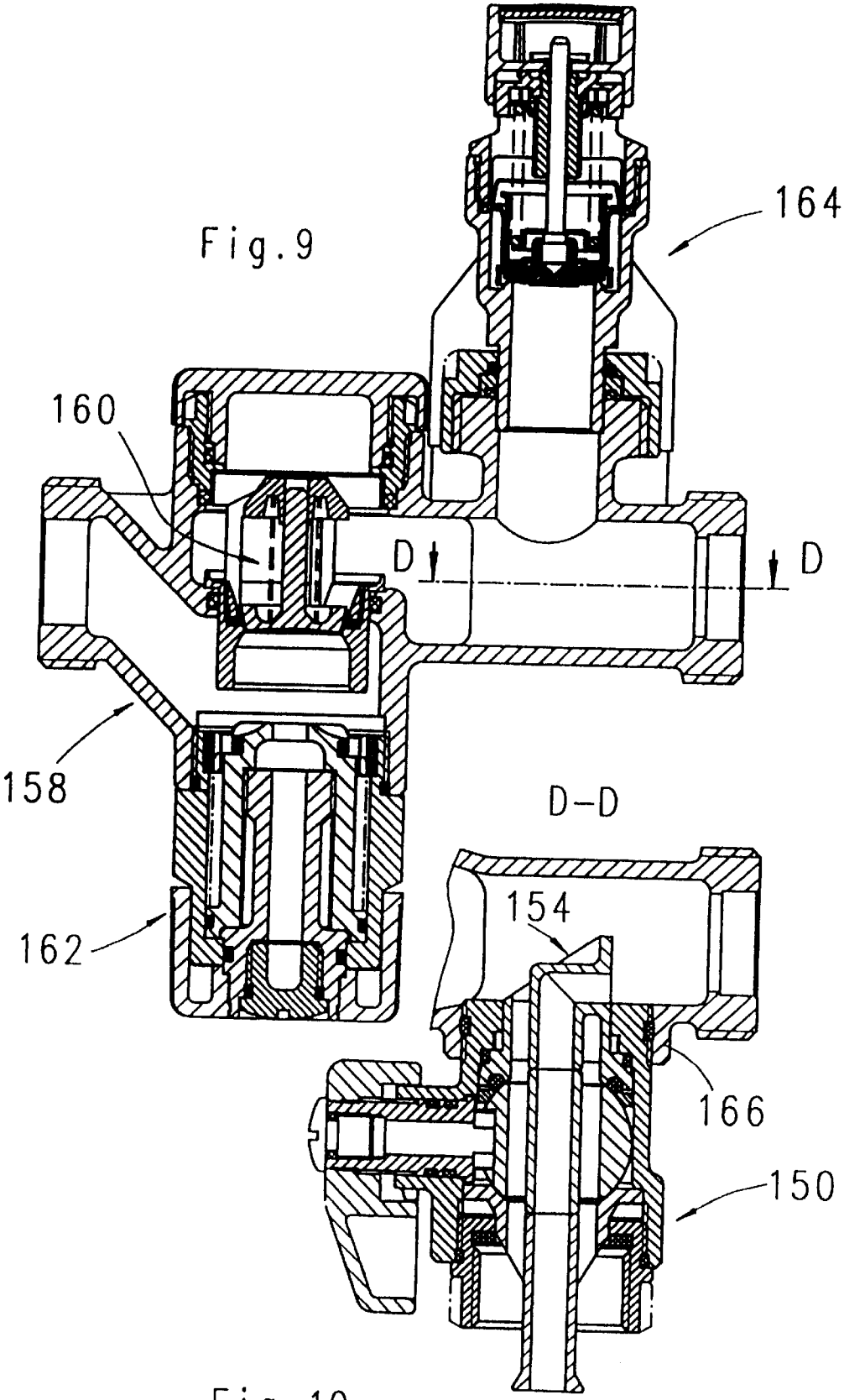
FIG. 9 shows a section of a safety group, which is combined with a connection fitting of the present type.
FIG. 10 shows a section taken along line D—D in FIG. 9.

It is known to build in a fitting having a backflow preventer, a check valve and a safety valve into closed drinking water heating systems. Such a fitting 158 having backflow preventer 160, check valve 162 and safety valve 164 is illustrated in FIG. 9. As can be seen in FIG. 10, such a fitting is provided with an additional lateral internally threaded connecting socket 166. An insert 150 according to FIG. 8 is screwed into this connecting socket 166, such that the suction device 154 extends into the through-passage.

I claim:

1. A connection fitting for connecting a pressure expansion vessel to a conduit system, in which a water flow flows, a diaphragm dividing said vessel into a cavity filled with water and a pressurized gas chamber filled with pressurized gas, comprising:

a fitting basic body having a connecting socket means for connecting said pressure expansion vessel with said connection fitting, a through-passage in said fitting basic body for connection into said conduit system to permit said water flow to flow through said through passage, flow path means in said connecting socket for connecting said through passage with said pressure expansion vessel, said flow path means comprising a forward flow path means for communicating said through passage with said pressure expansion vessel, and a return path means for communicating said pressure expansion vessel with said through-passage, said flow path means being arranged to define, together with said pressure expansion vessel, a flow path flow-parallel to at least part of said through-passage, hydrodynamic means in said through-passage for generating a water exchange flow through said flow path means and pressure expansion vessel along said parallel flow path, when a water flow flows through said through-passage, and a plug valve having a valve plug arranged to shut off said parallel flow path;

wherein said valve plug of said plug valve is arranged in said connecting socket for said pressure expansion vessel between a first formed body defining said hydrodynamic means and located adjacent to said water flow and a second formed body likewise located in said connecting socket on the side of said pressure expansion vessel;

said second formed body has a tubular central portion and an outer portion surrounding said central portion and connected to said central portion by webs;

said second formed body has a bearing surface for said valve plug;

said valve plug is held between said first formed body and said second formed body;

said first formed body has coaxial passages comprising an inner and an outer passage;

said second formed body has coaxial passages comprising an inner and an outer passage;

said coaxial passages of said formed bodies are aligned with each other;

said valve plug has coaxial passages comprising an inner and an outer passage; and said coaxial passages of said formed bodies are aligned with said coaxial passages of said valve plug in an operating position thereof, a first set of said aligned coaxial passages forming said forward flow path means and a second set of aligned coaxial passages forming said return flow path means.

2. The connection fitting of claim 1, wherein said valve plug is a valve ball of a ball valve.

3. The connection fitting of claim 2, wherein said first formed body has an O-ring and said valve ball engages said O-ring, a contact surface being formed between said O-ring and said valve ball.

4. The connection fitting of claim 3, wherein a supporting ring is inserted between said O-ring and said valve ball for holding said O-ring, said supporting ring engaging said O-ring and said valve ball outside said contact surface between said O-ring and said valve ball.

5. The connection fitting of claim 1, wherein said first set of coaxial passages forming said forward-flow pathmeans are outer passages and said second set of coaxial passages forming said return flow path means are inner passages.

6. The connection fitting of claim 1, wherein:

said first formed body has a central portion comprising said inner passage, the central portion extending into said water flow;

said inner passage of said first formed body having an end located on the outlet side, said end forming an angle and having a part extending in the direction of the water flow; and said outer passage of said first formed body communicates with said water flow through an inlet opening extending around said central portion.

7. The connection fitting of claim 6, wherein:

said first formed body comprises an outer portion, which is connected to said central portion through radial webs;

said outer portion has a tubular section extending into said water flow, which tubular section has an axis and is cut at an angle relative to said axis;

said section has a downstream wall part and an upstream wall part, said downstream wall part extending further into said water flow than said upstream wall part; and said part of said inner passage extending in the direction of the water flow extends through said downstream wall part of said outer portion.

8. The connection fitting of claim 6, wherein:

locking tappets are attached to said first formed body;

radial recesses are provided on the inside of said connecting socket; and said locking tappets extend into said recesses and thereby ensuring said first formed body to be inserted in correct angular position.

9. The connection fitting of claim 1, wherein said first formed body is made of synthetic plastic.

10. The connection fitting of claim 1, wherein:

said second formed body has a tubular central portion and an outer portion concentric to said central portion, said central portion and said outer portion being interconnected by radial webs;

said outer portion has an end facing said valve plug;

a flange is provided at said end of the outer portion, which flange is guided in said connecting socket and engages an annular shoulder of said connecting socket; and said second formed body has a concave bearing surface at an inner edge of said flange, which bearing surface is complementary to the outer surface of the valve plug and engages the valve plug.

11. The connection fitting of claim 10, wherein:

said connecting socket is internally threaded;

a sleeve-shaped screw-in element having an end face is screwed into said internally threaded connecting socket;

said end face engages said flange of said second formed body, such that said second formed body is held in the connecting socket.

12. The connection fitting of claim 10, wherein:

said screw-in element has an edge projecting inwards and extending subtantially up to said central portion of said second formed body; and a sealing washer engages said edge and is guided between an inner wall of the screw-in element and said central portion of said second formed body.

13. The connection fitting of claim 1, wherein:

an actuating spindle is arranged to rotate said valve plug about an axis perpendicular to the axis of said connecting socket by 90° into a locking position, in which said forward-flow path and said return-flow path are shut-off;

said actuating spindle has a longitudinal passage having an outer end remote from said valve plug, which end is closed by a detachable plug; and said valve plug forms a connection passage, through which said water-filled cavity of said pressure expansion vessel and said longitudinal passage communicate in said locking position.

14. The connection fitting of claim 13, wherein:

an actuating handle is attached to said actuating spindle;

a tappet is provided at said fitting basic body;

a recess is provided at said actuating handle, which recess is complementary to said tappet;

said tappet extends into said recess when the plug valve is in its open position, said actuating handle being locked against rotation;

said actuating handle is movably guided in axial direction relative to said actuating spindle and is adapted to be pushed in against the action of a spring; and said actuating handle, outwards of said recess, has an undercut extending over 90°, said tappet extending into said undercut when the actuating handle is pushed down, such that the actuating handle is adapted to be pivoted by 90° into a closed position of said plug valve when it is pushed down.

15. The connection fitting of claim 13, wherein:

said actuating spindle has a front face facing said valve plug and diametrically opposite ledges at said front face, which ledges extend to both sides of said longitudinal passage, said valve plug formed as valve ball has a slot;

said ledges extend into said slot;

an annular space is formed around said valve ball between said valve ball an said cylindrical inner wall of said connecting socket;

said connection passage is formed by at least one recess at the circumference of said valve ball; and a part of said forward-flow path on the side of said vessel and said annular space communicate with each other through said recess in said closed position.

16. The connection fitting of claim 14, wherein:

said actuating handle is guided on said actuating spindle through guiding surfaces, which have recesses having annular shoulders facing each other on said actuating handle and said actuating spindle;

a helical spring is arranged in said recesses and engages said annular shoulders; and a collar is provided at either one of said actuating handle or said actuating spindle, which collar coacts with a stop on the other one of said actuating handle or said actuating spindle in order to prevent said actuating handle to be pushed down from said actuating spindle under the action of said helical spring.

17. The connection fitting of claim 1, wherein said fitting basic body has an inlet, an outlet aligned with said inlet and a direct flow passage formed between said inlet and said outlet, an axis being defined by said inlet and said outlet, said connecting socket extending perpendicular to said axis and said suction device extending into said direct flow passage.

18. The connection fitting of claim 1, wherein said connecting socket containing said first formed body, said second formed body and said valve plug forms a separate component and has means for connecting said connecting socket to a conduit fitting.

19. A connection fitting for connecting a pressure expansion vessel to a conduit system, in which a water flow flows, a diaphragm dividing said vessel into a cavity filled with water and a pressurized gas chamber filled with pressurized gas, comprising:

a fitting basic body having a connecting socket means for connecting said pressure expansion vessel with said connection fitting, a through-passage in said fitting basic body for connection into said conduit system to permit said water flow to flow through said through passage, flow path means in said connecting socket for connecting said through passage with said pressure expansion vessel, said flow path means comprising a forward flow path means for communicating said through passage with said pressure expansion vessel, and a return path means for communicating said pressure expansion vessel with said through-passage, said flow path means being arranged to define, together with said pressure expansion vessel, a flow path flow-parallel to at least part of said through-passage, hydrodynamic means in said through-passage for generating a water exchange flow through said flow path means and pressure expansion vessel along said flow parallel flow path, when a water flow flows through said through-passage, wherein said forward flow path means and said return flow path means are formed by coaxial passages including an inner passage and an outer passage, said forward flow path means being formed by said outer coaxial passage and said return flow path being formed by said inner coaxial passage;

a formed body has a central portion comprising an inner passage forming a part of said return flow path means, said central portion extending into said through-passage;

said inner passage of said formed body having an end located on the outer side, said end forming an angle and having a part extending in the direction of the water flow;

an outer passage of said formed body being part of said forward-flow path communicates with said water flow through an inlet opening extending around said central portion.

20. The connection fitting of claim 19, wherein:

said formed body comprises an outer portion, which is connected to said central portion through radial webs;

said outer portion has a tubular section extending into said water flow, which tubular section has an axis and is cut at an angle relative to said axis;

said section has a downstream wall part and an upstream wall part, said downstream wall part extending fluter into said water flow than said upstream wall part; and said part of said inner passage extending in the direction of the water flow is guided through said downstream wall part of said outer portion.

21. The connection fitting of claim 19, wherein:

locking tappets are attached to said formed body;

radial recesses are provided on the inside of said connecting socket; and said locking tappets extend into said recesses and thereby ensuring said formed body to be inserted in correct angular position.

22. The connection fitting of claim 19, wherein said formed body is a synthetic body.

* * * * *